US005842779A

United States Patent [19]

Siebert

[11] Patent Number: 5,842,779

[45] Date of Patent: Dec. 1, 1998

[54] LOW POWER CONSUMPTION LIGHT

[76] Inventor: Benjamine J. Siebert, 1164 Lewis Ave., Apt. A, Kingsburg, Calif. 93631

[21] Appl. No.: 799,912

[22] Filed: Feb. 13, 1997

[51] Int. Cl.[6] ..... F21L 7/00; F21V 7/00; F21V 15/04

[52] U.S. Cl. ..... 362/309; 362/307; 362/308; 362/310; 362/311; 362/390; 362/391; 362/800; 362/802; 362/205; 362/194; 362/186

[58] Field of Search ..... 362/186, 194, 362/202, 205, 307, 308, 309, 310, 311, 390, 391, 448, 451, 452, 455, 800, 802

[56] References Cited

U.S. PATENT DOCUMENTS

| | | | |
|---|---|---|---|
| 4,360,862 | 11/1982 | Strasser et al. | 362/240 |
| 4,417,299 | 11/1983 | Rupp | 362/186 |
| 4,428,034 | 1/1984 | Seller | 362/186 |
| 4,885,670 | 12/1989 | Baake | 362/400 |
| 5,130,916 | 7/1992 | Toth | 362/386 |
| 5,170,332 | 12/1992 | Browne | 362/376 |
| 5,237,491 | 8/1993 | McCarter | 362/186 |
| 5,490,045 | 2/1996 | Lindner | 362/35 |
| 5,664,866 | 9/1997 | Reniger et al. | 362/61 |

*Primary Examiner*—Ira S. Lazarus
*Assistant Examiner*—Ljiljana V. Ciric
*Attorney, Agent, or Firm*—Richard A. Ryan

[57] ABSTRACT

A portable general illumination lamp unit having very low power consumption (under 100 mA) and producing a high intensity light. A dual conductor wire protrudes from the lamp housing body to connect to a power source. The lamp housing has a housing body, a flush fitting lid and a downward facing lens. The housing body has an exterior surface suitable for light diffusion. A low power, high intensity light bulb is attached to conductors on the wire using insulated wire straps, and a strain relief member is molded onto the dual conductor wire. The strain relief member is fixed to the lid of the lamp housing and sealed in place with a waterproof epoxy, oriented so that the bulb will be positioned in the center of the housing body. The housing body receives the lid. The opposite end of the wire lead can connect for permanent mounting of the device, or attach to a plug appropriate for the power source desired. Alternatively, the dual conductor wire can connect to a switch and one or more batteries.

28 Claims, 5 Drawing Sheets

LOW POWER CONSUMPTION LIGHT

BACKGROUND OF THE INVENTION

1. Field of the Invention

The present invention broadly relates to portable lights incorporating a bulb, a light diffuser or lens, and an electrical power source. In particular the device relates to outdoor area lights, generally powered with batteries.

2. Background

Portable outdoor area lights have a variety of uses, including boating, camping, and picnicking. They are generally powered by electrical current, however, there are some general illumination devices that are powered by the combustion of fuel. With regard to the devices powered by electrical current, they are generally powered by centrally distributed direct current power or batteries. In either case, they can provide good illumination but at the cost of significant power consumption and weight. In vehicles that do not have readily available access to a main power grid, such as sailboats, power boats and recreational vehicles, power consumption is of great concern. With regard to boating in particular, international law dictates that any vessel at anchor must display from sundown to sunrise an anchor light visible for at least one mile. With the average night being approximately twelve (12) hours, it is easy to see that lights currently available consume an amount of power that is unacceptable. The desire to limit power usage is so profound that many boaters disregard the law, thereby compromising safety, by leaving their anchor lights off and providing no illumination in the cockpit. In the application of backpacking the reduction of weight is paramount. Lights currently available either weigh too much to be considered or consume an amount of power that requires repeated battery replacement in a relatively short period of time.

3. Description of Prior Art

Several types of outdoor area lights have been proposed, including lights that fulfill the maritime law requirement of being visible from a distance of one mile. With regard to outdoor illumination, the prior art is heavy, relatively large and aesthetically unpleasing. In addition, the prior art of both outdoor area lights and anchor lights consume a significant amount of electrical power. Though the prior art devices have been utilized for many years, their use has been restricted due to a number of disadvantages.

One disadvantage is that the power consumption of the prior art requires the replacement of its batteries every four to five hours. This creates a number of related problems, including having to carry a significant number of heavy spare batteries, the need to discard exhausted batteries when no convenient or environmentally safe disposal method is available, disposal of toxic batteries into landfills and, foremost, the risk resulting from having no illumination when the spare battery supply is exhausted.

With regard to devices that are connected to a vehicle's main 12-volt power supply, the high power consumption of the prior art requires running the vehicle's engine so that the alternator may charge the large 12-volt power system. In vehicles that regularly have their engines running, such as power boats or cars, this is generally not a significant problem. However, in sailboats and recreational vehicles, weeks could go by between the occasions when the engine is needed for propulsion. Because of the high power consumption of the prior art, the auxiliary engines are run daily in order to charge the vehicle's batteries, creating noise and air pollution, consuming fossil fuels and being a general inconvenience. Should the operator fail to charge the batteries before they have become significantly depleted, the operator may find that there is not enough energy to start the engine when needed, causing inconvenience and possibly jeopardizing the safety of the operator and his or her passengers.

The weight of the existing devices is quite significant. Suspended at eye level, they pose a safety hazard. The potential exists for persons to bump their head or cut their eye or face with the heavier prior art devices, particularly in the rolling cockpit of a boat or yacht. In addition, their weight requires a much more robust suspension mechanism and an equally robust attachment surface.

The significant size of the prior art, particularly with regard to outdoor area illumination, creates a bulky item to store when not in use taking up valuable storage space that could be used for more important items. Long distance visibility lights are permanently mounted, making them difficult to service or replace should the device become defective. From an aesthetic view point, the outdoor general illumination lights currently available have their power sources attached, creating a large, unsightly device to look at. Generally, the battery storage to lamp-housing ratio of the prior art is approximately two-thirds battery compartment and one third illuminated light diffuser.

SUMMARY OF THE INVENTION

The low power consumption light in accordance with the present invention solves the problems associated with the prior art devices described above. That is to say, the present invention provides an electrically powered general illumination light that utilizes very low power consumption in a lightweight and compact unit.

It can be seen from the foregoing that the present invention provides a novel lamp unit structure which provides substantial area illumination at low power consumption with a remotely located power supply, the user choosing either battery operation, the use of a 12-volt accessory plug or permanent wiring.

In addition thereto, the present invention provides 360° illumination that can be seen from a distance sufficient to comply with Coast Guard standards for an anchor light. The low power consumption of the present invention allows it to remain on for long periods of time without undue drain on the batteries or 12-volt system. This is accomplished through the use of an extremely energy efficient light emanating source (i.e., light bulb or LED) and the creation of a current limiting circuit, which consists of a fixed voltage regulator to provide surge protection and a resistor to limit current flowing to the light source. The device could also utilize an ambient light-sensing photoelectric cell circuit to automatically turn the light on at dusk and off at dawn. Whereas existing general illumination and anchor lights consume approximately 800 mA per hour (with a few units providing illumination at around 300 mA), the present invention draws as low as 100 mA or less per hour (which can be less than one-eighth the electrical current used by the prior art). In addition, the fully wired currently available lamps provide an additional drain upon the vehicle's 12-volt battery possibly jeopardizing its primary job of starting the vehicle's engine. The present invention greatly reduces this risk. Alternatively, the unit may be utilized with its own power source through the use of a battery pack, thereby completely eliminating the risk of discharging the vehicle's 12-volt system.

The following advantages of the present invention will become apparent when reading the accompanying description and drawings:

(a) relatively low power consumption;

(b) the light from the device is highly visible from a long distance;

(c) the lamp unit is capable of being energized remotely from a variety of power sources;

(d) reduces the number of spare batteries required for extended use of the lamp unit, thereby reducing weight and the need to discard drained batteries;

(e) reduces the frequency of utilizing a vehicle's engine charging system to charge the 12-volt system;

(f) the device is compact and lightweight such that it will not injure people accidentally struck with the device, can be carried without effort, is easily stored and is aesthetically pleasing;

(g) the illumination unit is easily serviced and replaced;

(h) the small size and light weight of the device allows it to be suspended by its wire lead with an attachment support that need only be strong enough to support the light weight of the device; and (j) because the power consumption of the present invention is so low, it reduces the tendency of sailors to disobey the law regarding the display of anchor lights.

Accordingly, the primary objective of the present invention is to provide a lamp unit of the character described herein, wherein the device utilizes very low power consumption to produce a light visible from a great distance in a relatively compact and lightweight unit.

It is also an important objective of the present invention to provide a low power consumption lamp unit having 360° illumination through a lamp housing body having a light diffusion mechanism suitable for producing a light visible from a great distance.

Another important objective of the present invention is to provide a low power consumption lamp unit having a lens on one end suitable for providing concentrated light downward from the lamp unit to illuminate the area below the lamp unit.

Yet another important objective of the present invention is to provide a low power consumption lamp unit suitable for being powered by a variety of power sources, including small portable batteries and larger 12-volt automobile-type batteries.

Yet another important objective of the present invention is to provide a low power consumption lamp unit that is suitable for use in boating, camping, backpacking and other similar uses where low weight, durability and power supply are important.

Yet another important objective of the present invention is to provide a low power consumption lamp unit capable of being suspended from the electrical conductor wire used to conduct electricity from the power source to the light bulb contained within the lamp unit.

BRIEF DESCRIPTION OF THE DRAWINGS

In the drawings which illustrate the best modes presently contemplated for carrying out the present invention, closely related figures have the same number but different alphabetic suffixes.

Figure 1:
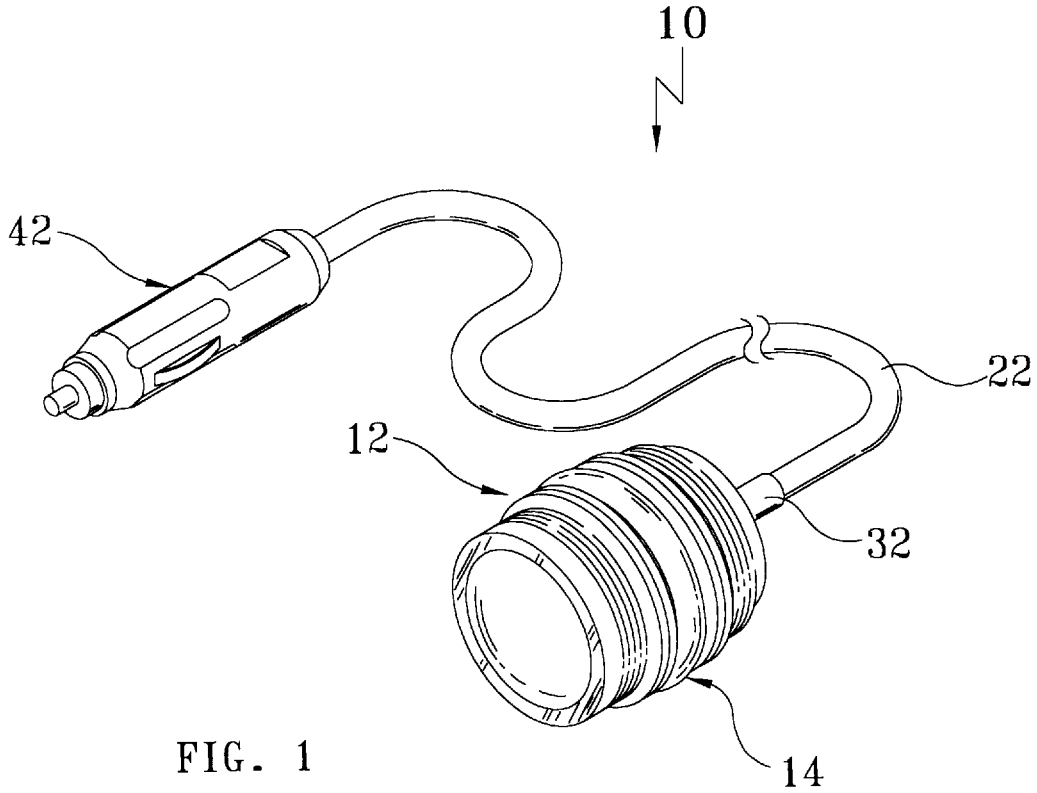
FIG. 1 is a perspective view showing a lamp unit embodying the principles of the present invention.

| REFERENCE NUMERALS IN DRAWINGS | |
|---|---|
| 10 | lamp unit (present invention) |
| 12 | lamp housing |
| 14 | lamp housing body |
| 16 | housing lid |
| 18 | lens |
| 19 | set screw |
| 20 | light bulb |
| 22 | electrical conductor wire |
| 24 | exterior surface of lamp housing body |
| 26 | top wall |
| 28 | side wall |
| 30 | opening |
| 32 | molded strain relief member |
| 34 | light bulb wire leads |
| 35 | voltage regulator |
| 36 | resistor |
| 37 | positive conductor |
| 38 | negative conductor |
| 40 | insulated wire straps |
| 42 | 12-volt accessory plug |
| 44 | battery pack |
| 46 | 12-volt accessory plug - main body |
| 48 | 12-volt accessory plug - fuse access screw |
| 50 | electrical current-to-fuse protuberance |
| 52 | fuse |
| 54 | spring |
| 56 | on-off switch |
| 58 | second molded strain relief member |

DETAILED DESCRIPTION OF THE PREFERRED EMBODIMENTS

With reference to FIGS. 1 through 5, where like elements have been given like numerical designations to facilitate understanding of the present invention, the low power consumption lamp unit is designated generally 10. In the preferred embodiment, lamp unit 10 includes a lamp housing 12 having a hollow housing body 14, a housing lid 16 and a lens 18 substantially opposite housing lid 16. A low power consumption, high intensity illumination light bulb 20 is secured in lamp housing body 14 and electrically connected to a power source via electrical conductor wire 22.

Lamp housing body 14 can be a substantially cylindrical shaped hollow body having a substantially smooth and vertical interior surface (not shown). Alternatively, the interior surface of the lamp housing body 14 can take the shape of the body 14 itself. The exterior surface 24 of lamp housing body 14 should comprise a light diffuser for diffusing the light from light bulb 20. The light diffuser can be a series of circular, concentric striations that increase in number and frequency from the center of lamp housing body 14 to form a Fresnel-type lens, as shown in FIGS. 1 through 5. Housing body 14 can be formed of a single piece of suitable transparent acrylic material. Preferably, the material for housing body 14 should be lightweight and substantially shatter, weather and corrosion resistant. Housing lid 16 can be unpolished or opaque. Alternatively, housing lid 16 may be polished or clear. Variations in the design or materials for lamp housing body 14 are possible without departing from the invention set forth herein. For example, housing body 14 can have other shapes such as square, oval, round, trapezoidal or triangular and still accomplish the objectives of the present inventions. If desired, the lamp housing body 14 can be made of glass or glass-like material.

In the preferred embodiment, housing lid 16 comprises a top wall 26 having integral side walls 28 extending therefrom in a generally perpendicular direction. Housing lid 16 can be fixedly secured or removably coupled or attached to housing body 14 using a water-resistent epoxy, matching threads, one or more set screws or any other of numerous securing, coupling or attaching mechanisms known to those skilled in the art. Housing lid 16 is provided with an opening 30 in top wall 26. A molded strain relief member 32 is inserted through opening 30 in housing lid 16 to reduce the strain on wire 22 when lamp unit 10 is suspended by wire 22. Opening 30 and strain relief member 32 are aligned on a common longitudinal axis to align housing body 14 with housing lid 16 and to dispose of light bulb 20 near the center of lamp housing 12. Opening 30 cooperates with molded strain relief member 32 to form a slidably embracing tubular projection of molded strain relief member 32 exiting from the top of lamp housing lid 16. One end of electrical conductor wire 22 protrudes through strain relief member 32 into lamp housing body 14 and attaches to the current limiting circuitry described in the following paragraphs, which in turn attaches to light bulb 20. The other end of wire 22 continues to the power supply.

In the preferred embodiment, lens 18 is located on lamp housing body 14 opposite lamp housing lid 16 and oriented downward when the lamp unit 10 is in a vertically hanging position. In this configuration, an expanding cylinder of light is projected from the lamp unit 10 to illuminate the surface below. The size of the lens can be approximately the same diameter or size as lamp housing body 14. Lens 18 should have a convex exterior shape, thereby forming a true lens. Lens 18 can be molded and, therefore, integral with lamp housing body 14 such that the lamp housing body 14 and lens 18 are a single unit. Alternatively, lens 18 can be part of a separate component, such as a lens frame member, that either fixedly or removably attaches lens 18 to lamp housing body 14 using waterproof epoxy, matching threads, one or more set screws 19 or the like.

Inside lamp housing 12 is a low power consumption, high intensity illumination light bulb 20 having light bulb wire leads 34. Light bulb 20 can be any low power consumption, high intensity light emanating source, such as found with some LEDs or light bulbs. If power consumption is not a concern, then light bulb 20 can be any standard light bulb, LED or other light emanating source. Attached to one of the wire leads 34 is voltage regulator 35 and resistor 36 in electrical series. The voltage regulator can be a Zener diode or other suitable voltage regulating device that is, in conjunction with the resistor, suitable for providing sufficient surge and current limiting circuitry. The opposite end of resistor 36 is affixed to the positive conductor 37 of electrical conductor wire 22 using an insulated wire strap 40. The other wire lead from light bulb 20 is affixed to the negative conductor 38 of electrical conductor wire 22 using a second insulated wire strap 40. The opposite end of electrical conductor wire 22 connects to the power supply to provide electrical power to energize light bulb 20. Light bulb 20 may, for example, be a number ML-612 (6–12 volts/55–100 mA) wire leaded bulb available from Caltronics. Light bulb 20 should be located near the center of lamp housing body 14 where there are the fewest striations on exterior surface 24 to best make use of the physical properties and light focusing and bending characteristics of the Fresnel lens. The opposite end of wire 22 from the light bulb 20 can attach to a 12-volt accessory plug 42 (shown in FIGS. 1 and 2), a battery pack 44 (shown in FIG. 3), or just left bare for attachment to permanent wiring. The power source may be permanently affixed to lamp housing body 14 to create a more compact device. When used with battery pack 44, an electrical or solar charger can be used to keep the battery pack 44 in a charged condition.

Figure 2:
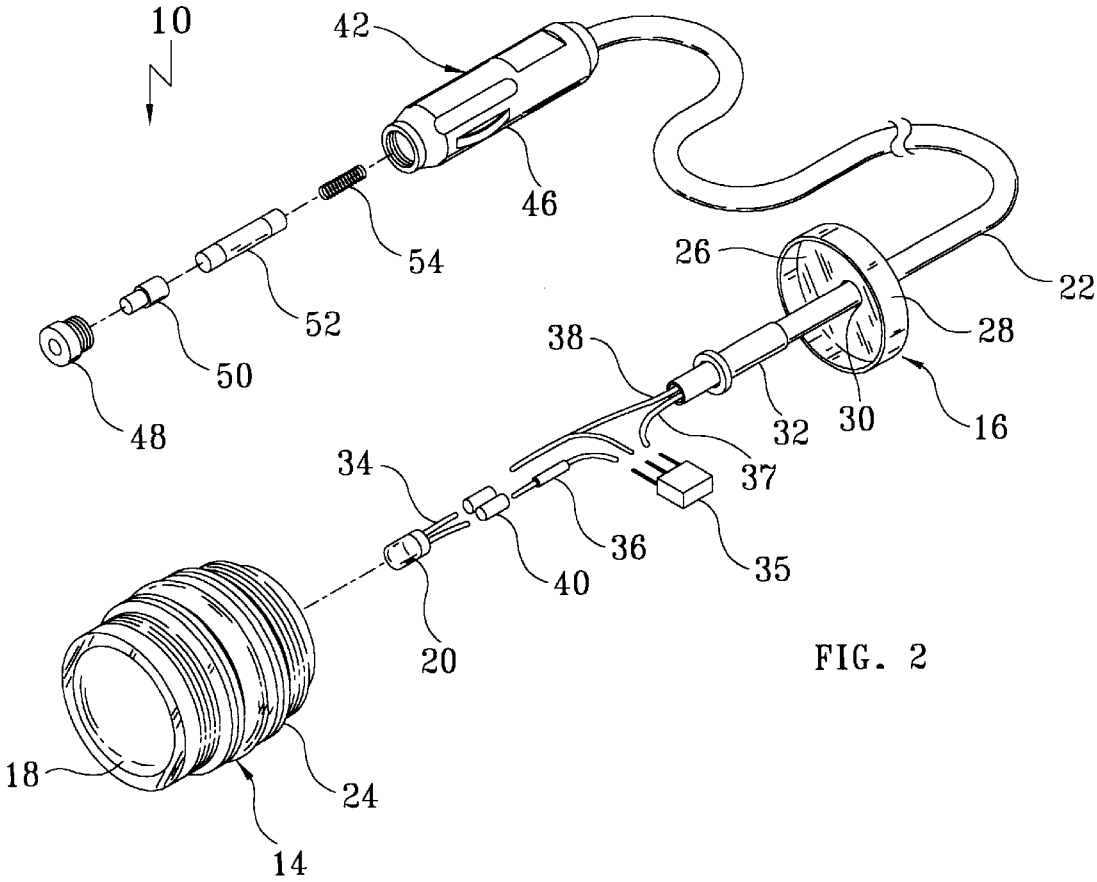
FIG. 2 shows an exploded perspective view of the lamp unit of FIG. 1 with the 12-volt accessory plug attachment.
Figure 3:
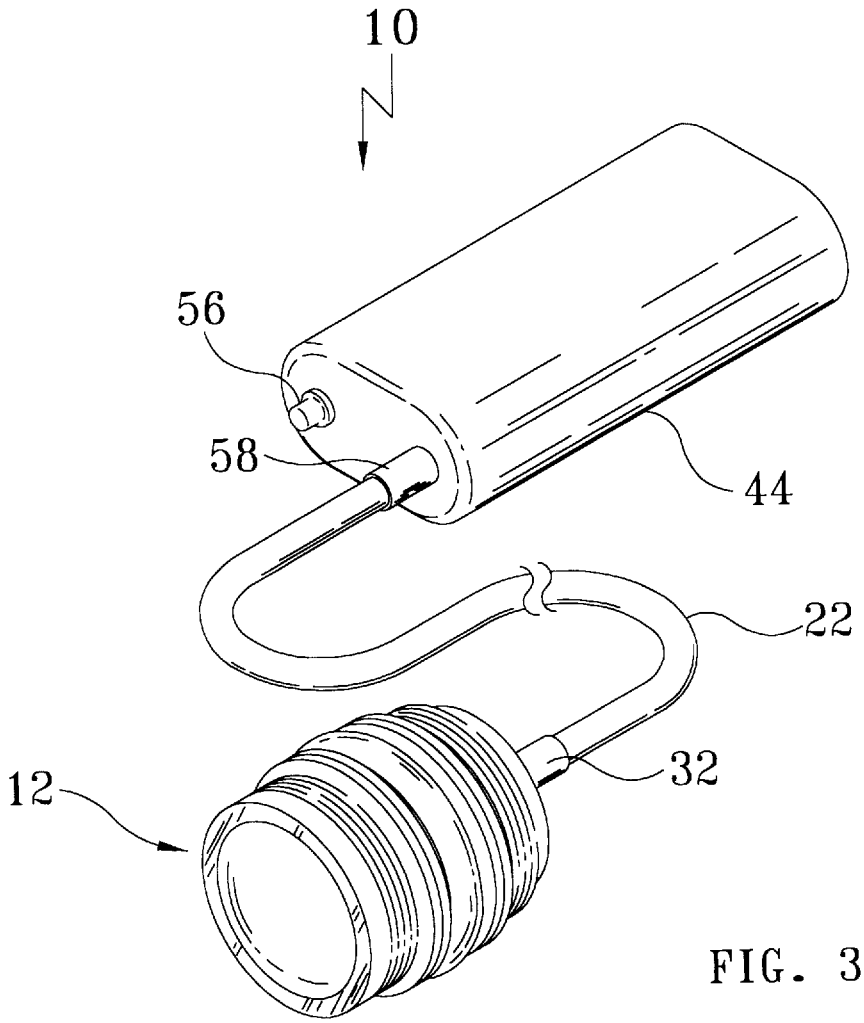
FIG. 3 is a perspective view showing a lamp unit attached to the battery pack variation.
Figure 4:
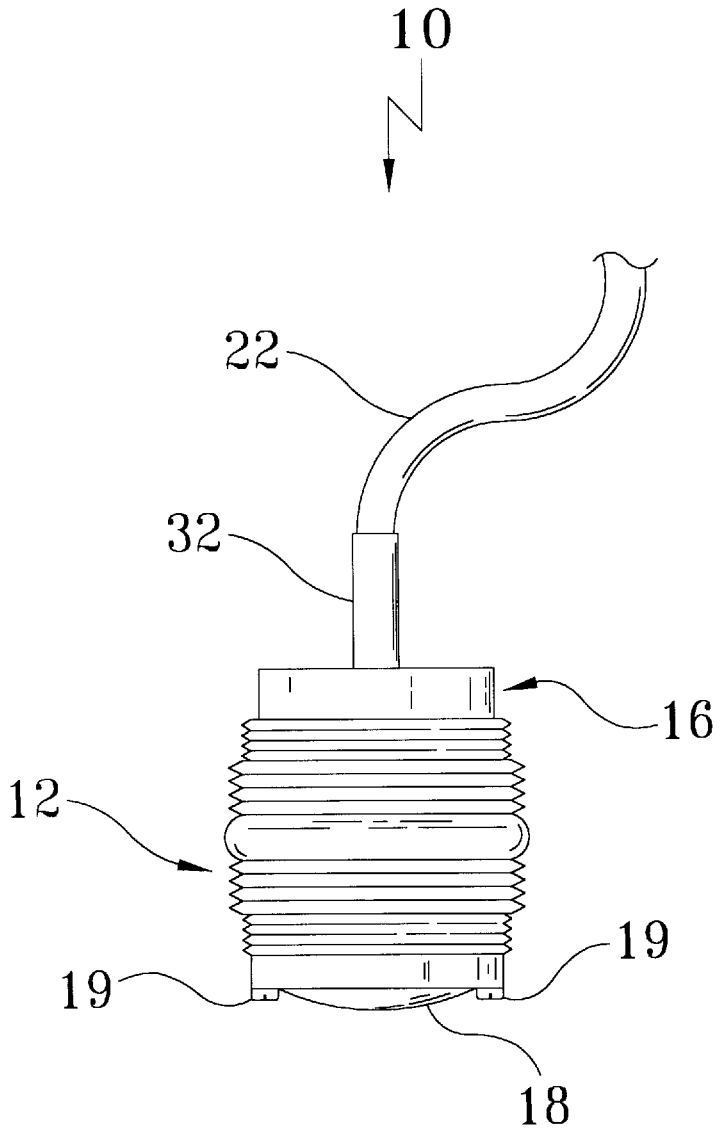
FIG. 4 is an elevated view of the present invention in assembled form.
Figure 5:
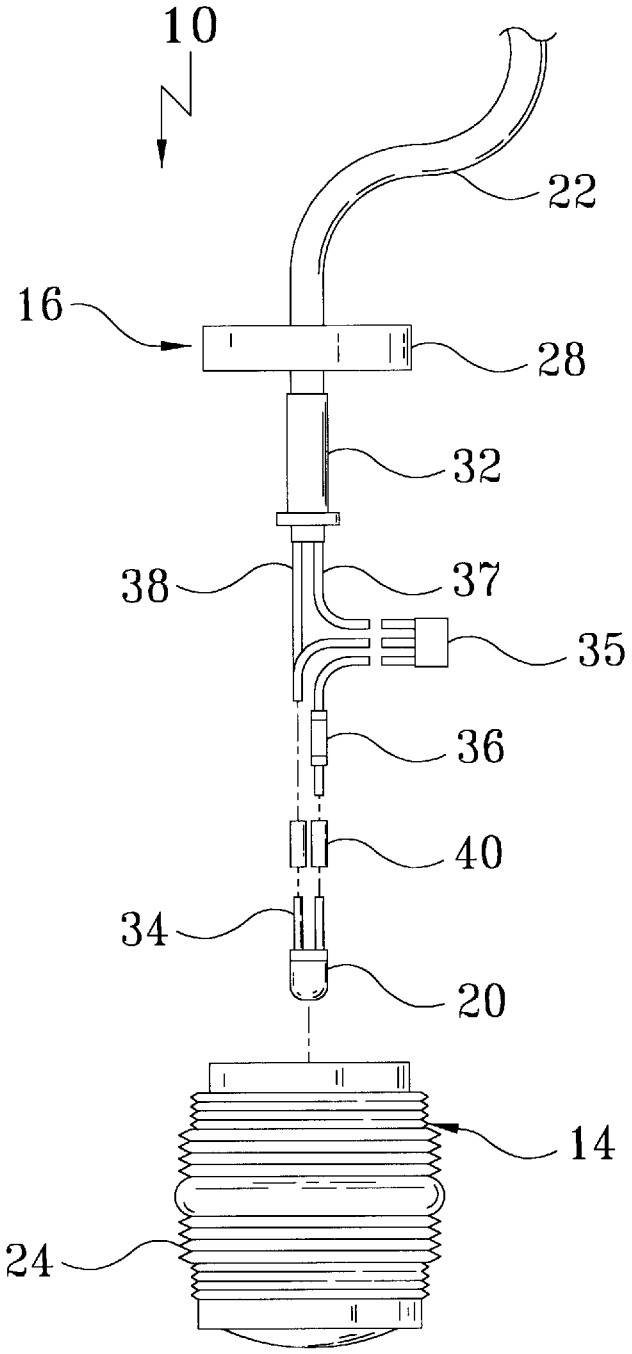
FIG. 5 is an exploded elevated view of the lamp housing unit and the circuitry therein.

The present invention 10 can be electrically connected to a variety of power sources via electrical conductor wire 22. In FIGS. 1 and 2, dual conductor wire 22 attaches to a standard 12-volt accessory plug 42. The typical 12-volt accessory plug 42 comprises main body 46 and fuse access screw 48. An electrical current-to-fuse protuberance 50 slides over fuse 52. The electrical current-to-fuse protuberance 50 and fuse 52 assembly is held in place against an electrical contact via spring 54. In FIG. 3 the power source is a battery pack 44. Battery pack 44 can have an on-off switch 56. Electrical conductor wire 22 enters battery pack 44 through a second molded strain relief member 58.

Although not shown in the enclosed figures, lamp unit 10 can further comprise an ambient light-sensing photoelectric cell and accompanying circuitry electrically connected between light bulb 20 and the power source to automatically turn the light on at dusk and turn it off at dawn.

In an alternative embodiment (not shown), lamp unit 10 has lens 18 integral with housing lid 16, which is removably coupled to one end of housing body 14. Housing lid 16 can removably couple to housing body 14 using matching threads on housing lid 16 and housing body 14, one or more set screws or any other type of coupling or connecting mechanisms that are known to those skilled in the art. The opposite end of housing body 14 has opening 30 allowing wire 22 and strain relief member 32 to protrude therefrom. Although the strain relief member 32 shown in the referenced figures is the preferred method for the present invention, other means of reducing strain on wire 22 are known to those skilled in the art to allow the lamp unit 10 to be suspended by wire 22.

From the figures and descriptions provided herein, the reader will see that the device of the present invention can be used for low power level illumination and long range visibility. By reducing the amount of batteries needing to be replaced or reducing the cycles between 12-volt system battery charges, money and inconvenience is saved, pollution is reduced and the enjoyment of boaters, recreational vehicle owners and campers is significantly increased. In addition, boat owners are more likely to comply with the legal requirement of showing an anchor light visible for over one mile from dusk to dawn. The low power consumption light of the present invention has the additional advantages set forth below:

- it consumes only 100 mA or less per hour;
- it is lightweight, thereby reducing risk of injury from bumping one's head, allowing for a very light weight attachment system and suspension structure and providing great benefit to backpackers;
- it is aesthetically more pleasing due to the remote location of the power source and because the entire visible device is completely illuminated;
- it provides increased safety by reducing the potential for an exhausted engine starting battery;
- it provides easy servicing due to its portable mounting application; and
- it eliminates the concern of power consumption when illuminating an anchor light to comply with legal requirements.

Although the description above contains many specificities, these should not be construed as limiting the scope of the invention but as merely providing illustrations of some of the presently preferred embodiments of this invention. It will be readily apparent to those skilled in the art that the invention is not limited by the examples given, but is susceptible to various modifications in design and materials without departing from the spirit and scope of the invention. In particular, it should be noted that the present invention is subject to modification with regard to the dimensional relationships set forth herein and modifications in assembly, materials, size, shape and use. Accordingly, it is appropriate that the appended claims be construed broadly and in a manner consistent with the spirit and scope of the invention described herein, rather than by the examples given.

I claim:

1. A low power consumption lamp unit comprising:

a lamp housing having a housing body made of a transparent material, a housing lid and a lens, said housing body having an external surface, a first end and a second end, said second end substantially opposite said first end, said housing lid having an opening therein;

lid coupling means at said first end of said housing body for removably coupling said housing lid to said housing body;

lens securing means at said second end of said housing body for securing said lens to said housing body;

a low power consumption, high intensity light emanating source;

securing means for securing said light emanating source in said lamp housing;

light diffusing means on said external surface of said housing body for diffusing light emanating from said light emanating source;

a power source; and a length of electrically conductive wire interconnecting said light emanating source and said power source, said electrically conductive wire exiting said lamp housing through said opening in said housing lid.

2. The lamp unit of claim 1, wherein said lens is integral with said housing body.

3. The lamp unit of claim 1, wherein said light emanating source securing means includes strain reducing means at said opening for reducing the strain on said electrically conductive wire when said lamp housing is suspended by said electrically conductive wire, said strain reducing means longitudinally aligned with said opening to dispose said light emanating source near the center of said lamp housing.

4. The lamp unit of claim 3, wherein said strain reducing means comprises a strain reducing member disposed around said electrically conductive wire.

5. The lamp unit of claim 1, wherein said housing body is formed of a lightweight and substantially shatter and corrosion resistant material.

6. The lamp unit of claim 1, wherein said light emanating source consumes less than 300 mA of electricity per hour.

7. The lamp unit of claim 6, wherein said light emanating source consumes less than 100 mA of electricity per hour.

8. The lamp unit of claim 1, further comprising switching means for alternatively connecting and disconnecting said power source from said light emanating source.

9. A low power consumption lamp unit comprising:

a lamp housing having a housing body made of a transparent material, a housing lid and a lens, said housing body having an external surface, a first end and a second end, said second end substantially opposite said first end;

lid coupling means for removably coupling said housing lid to said housing body;

a low power consumption, high intensity light emanating source;

securing means for securing said light emanating source in said lamp housing;

light diffusing means on said external surface of said housing body for diffusing light emanating from said light emanating source;

a power source;

a length of electrically conductive wire interconnecting said light emanating source and said power source;

voltage regulating means in electrical communication with and disposed between said light emanating source and said power source for regulating the amount of voltage received by said light emanating source; and current limiting means in electrical communication with and disposed between said light emanating source and said power source for limiting the current demand of said light emanating source.

10. The lamp unit of claim 9, wherein said lens is integral with said housing body.

11. The lamp unit of claim 9, further comprising lens securing means at said second end of said housing body for securing said lens to said housing body and an opening in said housing lid, wherein said lid coupling means is at said first end, said electrically conductive wire exits said lamp housing through said opening in said housing lid and said light emanating source securing means includes a strain reducing member disposed around said electrically conductive wire at said opening for reducing the strain on said electrically conductive wire when said lamp housing is suspended by said electrically conductive wire, said strain reducing member being longitudinally aligned with said opening to dispose said light emanating source near the center of said lamp housing.

12. The lamp unit of claim 9, wherein said lens is secured within said housing lid, said lid coupling means is at said second end, said first end of said housing body has an opening, said electrically conductive wire exits said lamp housing through said opening and said light emanating source securing means includes a strain reducing member at said opening for reducing the strain on said electrically conductive wire when said lamp housing is suspended by said electrically conductive wire, said strain reducing member longitudinally aligned with said opening to dispose said light emanating source near the center of said lamp housing.

13. The lamp unit of claim 9, wherein said light diffusing means comprises a plurality of concentric striations on said exterior surface of said housing body, said plurality of concentric striations forming a Fresnel lens.

14. A low power consumption lamp unit comprising:

a lamp housing having a hollow housing body, a housing lid and a lens, said housing body having an external surface a first end and a second end, said external surface having a plurality of concentric striations forming a Fresnel lens, said second end substantially opposite said first end, said housing body being formed of a lightweight and substantially shatter and corrosion resistant material, said housing lid having an opening, said lens integral with said housing body;

lid coupling means at said first end of said housing body for removably coupling said housing lid to said housing body;

a low power consumption, high intensity light emanating source;

securing means for securing said light emanating source in said lamp housing;

a power source;

a length of electrically conductive wire interconnecting said light emanating source and said power source;

voltage regulating means in electrical communication with and disposed between said light emanating source and said power source for regulating the amount of voltage received by said light emanating source; and current limiting means in electrical communication with and disposed between said light emanating source and said power source for limiting the current demand of said light emanating source.

15. The lamp unit of claim 14, wherein said electrically conductive wire exits said lamp housing through said opening in said housing lid and said light emanating source securing means includes a strain reducing member disposed around said electrically conductive wire at said opening for reducing the strain on said electrically conductive wire when said lamp housing is suspended by said electrically conductive wire, said strain reducing member being longitudinally aligned with said opening to dispose said light emanating source near the center of said lamp housing.

16. A low power consumption lamp unit comprising:

a lamp housing having a hollow housing body and a housing lid, said housing body having an external surface, a first end and a second end, said second end substantially opposite said first end, said housing lid having a lens, said first end of said housing body having an opening;

lid coupling means at said second end for removably coupling said housing lid to said housing body;

a low power consumption, high intensity light emanating source;

light diffusing means on said external surface of said housing body for diffusing light emanating from said light emanating source;

a power source;

a length of electrically conductive wire interconnecting said light emanating source and said power source, said electrically conductive wire exiting said lamp housing through said opening; and securing means for securing said light emanating source in said lamp housing, said light securing means having a strain reducing member at said opening for reducing the strain on said electrically conductive wire when said lamp housing is suspended by said electrically conductive wire, said strain reducing member longitudinally aligned with said opening to dispose said light emanating source near the center of said lamp housing.

17. A low power consumption lamp unit comprising:

a lamp housing having a housing body made of a transparent material, a housing lid and a lens, said housing body having an external surface, a first end and a second end, said second end substantially opposite said first end;

lid coupling means for removably coupling said housing lid to said housing body;

a low power consumption, high intensity light emanating source;

securing means for securing said light emanating source in said lamp housing;

light diffusing means on said external surface of said housing body for diffusing light emanating from said light emanating source, said light diffusing means comprising a plurality of concentric striations on said exterior surface of said housing body, said plurality of concentric striations forming a Fresnel lens;

a power source; and a length of electrically conductive wire interconnecting said light emanating source and said power source.

18. The lamp unit of claim 17, wherein said light emanating source securing means includes strain reducing means at said opening for reducing the strain on said electrically conductive wire when said lamp housing is suspended by said electrically conductive wire, said strain reducing means longitudinally aligned with said opening to dispose said light emanating source near the center of said lamp housing.

19. The lamp unit of claim 17, wherein said light emanating source consumes less than 300 mA of electricity per hour.

20. The lamp unit of claim 19, wherein said light emanating source consumes less than 100 mA of electricity per hour.

21. The lamp unit of claim 17, wherein said housing body is formed of a lightweight and substantially shatter and corrosion resistant material and said lens is integral with said housing body.

22. The lamp unit of claim 17 further comprising voltage regulating means for regulating the amount of voltage received by said light emanating source and current limiting means for limiting the current demand of said light emanating source, said voltage regulating means and said current limiting means in electrical communication with and disposed between said light emanating source and said power source.

23. A low power consumption lamp unit comprising:

a lamp housing having a housing body made of a transparent material, a housing lid and a lens, said housing body having an external surface, a first end and a second end, said second end substantially opposite said first end;

lid coupling means for removably coupling said housing lid to said housing body;

low power consumption, high intensity light emanating source;

securing means for securing said light emanating source in said lamp housing;

light diffusing means on said external surface of said housing body for diffusing light emanating from said light emanating source;

a power source;

a length of electrically conductive wire interconnecting said light emanating source and said power source; and connecting means disposed between said electrically conductive wire and said power source for removably connecting said electrically conductive wire to said power source.

24. The lamp unit of claim 23, wherein said light securing means includes strain reducing means at said opening for reducing the strain on said electrically conductive wire when said lamp housing is suspended by said electrically conductive wire, said strain reducing means longitudinally aligned with said opening to dispose said light emanating source near the center of said lamp housing.

25. The lamp unit of claim 23, wherein said light emanating source consumes less than 300 mA of electricity per hour.

26. The lamp unit of claim 25, wherein said light emanating source consumes less than 100 mA of electricity per hour.

27. The lamp unit of claim 23, wherein said housing body is formed of a lightweight and substantially shatter and corrosion resistant material and said lens is integral with said housing body.

28. The lamp unit of claim 23 further comprising voltage regulating means for regulating the amount of voltage received by said light emanating source and current limiting means for limiting the current demand of said light emanating source, said voltage regulating means and said current limiting means in electrical communication with and disposed between said light emanating source and said power source.

* * * * *